US006795527B2

(12) United States Patent
Francke

(10) Patent No.: US 6,795,527 B2
(45) Date of Patent: Sep. 21, 2004

(54) APPARATUS AND METHOD FOR DETECTION OF RADIATION

(75) Inventor: Tom Francke, Sollentuna (SE)

(73) Assignee: XCounter AB, Danderyd (SE)

( * ) Notice: Subject to any disclaimer, the term of this patent is extended or adjusted under 35 U.S.C. 154(b) by 270 days.

(21) Appl. No.: 10/127,561

(22) Filed: Apr. 23, 2002

(65) Prior Publication Data

US 2003/0156677 A1 Aug. 21, 2003

(30) Foreign Application Priority Data

Feb. 15, 2002 (SE) ..... 0200445

(51) Int. Cl.[7] ..... G21K 5/10
(52) U.S. Cl. ..... 378/146; 378/147
(58) Field of Search ..... 378/146, 147, 378/148, 98.8

(56) References Cited

U.S. PATENT DOCUMENTS 5,040,199 A * 8/1991 Stein ..... 378/56
6,118,125 A * 9/2000 Carlson et al. ..... 250/385.1
6,304,626 B1 * 10/2001 Adachi et al. ..... 378/19
6,373,065 B1 4/2002 Francke et al. ..... 250/374

* cited by examiner

*Primary Examiner*—Craig E. Church
*Assistant Examiner*—Irakli Kiknadze
(74) *Attorney, Agent, or Firm*—Harness, Dickey & Pierce, P.L.C.

(57) ABSTRACT

The present invention relates to an apparatus and a method for detection of radiation comprising at least a first collimator arranged to transmitted radiation through at least a first slit in a Z-direction and prevent radiation in said Z-direction apart from through said at least first slit. The invention further comprises at least a first array of at least two radiation detecting elements, that each of said radiation detecting elements having α length a in an X-direction, where said X-direction is the direction of said array of radiation detecting elements, that each of said radiation detecting elements having a length β in a Y-direction, that said at least first slit, for letting through radiation in the Z-direction, has a length in said second X-direction which is at least as long as said array of radiation detecting elements, that said at least first slit has a length in said Y-direction which is substantially shorter than said length β of said radiation detecting elements, and displacement means arranged to move said collimator and/or said array of radiation detecting elements.

36 Claims, 5 Drawing Sheets

APPARATUS AND METHOD FOR DETECTION OF RADIATION

TECHNICAL FIELD

The present invention relates to detection of radiation. More specifically, the present invention relates to detection of radiation, particularly X-ray radiation, using scanning.

BACKGROUND OF THE INVENTION

Film has been used in medical X-ray imaging for more than 100 years, and is yet the dominating technique for X-ray detection at hospitals all over the world. The largest improvement came in the 1960s when embedding the film in a fluorescenting screen to increase the sensitivity drastically reduced the dose, but at the expense of a reduced position resolution.

In the middle of the 1990s, the first digital technique appeared on the market, where the X-ray illumination gives digital signals in the detector, for creating digital images. These detectors either convert the X-ray flux to visible photons in a scintillator or to charge in a semiconductor. The light from the scintillator is detected with e.g. a TFT or a CCD (Charged Coupled Device), and the charge from the semiconductor is detected using e.g. a TFT (Thin Film Transistor). These techniques solves some of the problems associated with using film, but still have some drawbacks.

The basic CCD consists of a series of metal oxide-semiconductor capacitors that are fabricated close together on a semiconductor surface. Today, CCDs are used in a wide variety of indirect-conversion X-ray imaging devices, including large-area radiographic imaging systems. The single most salient characteristic of CCDs with regard to radiography is that they are physically small in size, typically 2–4 $cm^2$, which is much smaller than typically projected X-ray areas. Because of this, cost-effective CCD-based radiographic systems must include some means of optical coupling to reduce the size of the projected visible light image and to transfer the image to the face of one or more CCDs. Some systems are based on an array of CCD cameras, each of which is coupled to a scintillator by a lens or fibre optic taper.

Recent advantages in photolithography and electronic micro fabrication techniques have enabled the development of large area x-ray detectors with integrated readout mechanisms based on arrays of TFT. Unlike CCD-based detectors that require optical coupling and image demagnification, TFT-based, flat panel systems are constructed such that the pixel charge collection and readout electronics for each pixel are immediately adjacent to the position of the X-ray interactions. TFT-arrays are used as active electronic elements in both indirect and direct conversion flat panel detectors. In indirect systems X-rays produces light in scintillators, which is optically coupled to a light sensitive device where the produced light is converted into charges, which are detected. In direct systems X-rays directly produces charges, which are detected.

TFT-arrays are typically deposited onto a glass substrate in multiple layers, beginning with readout electronics at the lowest level and followed by charged collector arrays at higher levels. Depending on the type of detector, X-ray-elements (direct conversion), light-sensitive elements (indirect conversion) or both, are deposited to form the top layer of the electronic sandwich structure.

Typically, amorphous selenium is used as conversion material, due to its good X-ray detection possibilities and high intrinsic spatial resolution, in direct conversion TFT systems. Before exposure, an electric field is applied across the amorphous selenium layer through a bias electrode on the top surface of the selenium. As X-rays are absorbed in the detector, electrons and holes are released within the selenium, and due to the electric field within the selenium, electric charges are drawn directly to the charge collecting electrodes. Pixels are separated by means of field shaping within the selenium layer.

Indirect conversion systems based on TFT-arrays are constructed by adding an amorphous silicon photodiode circuitry and a scintillator optically coupled to the top layers of the TFT sandwich. When X-rays strike the scintillator, visible light is emitted proportional to the incident X-ray energy. Visible light photons are then converted into an electric charge by the photodiode array.

TFT-arrays, however, have a limited position resolution set by the minimum pixel size, which is currently limited to approximately 100 $\mu$m×100 $\mu$m. Researchers are currently reaching minimum pixel sizes as small as 70 $\mu$m×70 $\mu$m, whereas for affordable consumer products pixel sizes are still reasonably large, for instance approximately 450 $\mu$m×450 $\mu$m in computer screens. It would be advantageous if the resolution achieved in X-ray imaging could be made even greater.

Large TFT-array systems are also costly. An array, with maximum resolution, i.e. 100 $\mu$m×100 $\mu$m, and a size of 25 cm×25 cm will have 6.25 million individual pixels and would cost more than approximately $100000. The high cost is mainly due to a low yield when trying to minimize the area of the thin-film transistor in amorphous silicon under the requirement that very few dead pixels are allowed.

One individual pixel comprises for indirect systems, apart from the X-ray detecting means, a photo diode for detecting the light, a capacitor for storing the charge, a switch transistor for reading out the value of the pixel, data and address lines and an isolation distance. This means that a relative small part is available for the X-ray detecting means, for a 100 $\mu$m×100 $\mu$m pixel only approximately 50%. This is called the fill factor.

It would be advantageous if the cost could be reduced, while keeping the position resolution high and the size large.

Another problem with conventional X-ray detecting apparatuses is that the X-rays is scattered in the object to be imaged. Approximately as much as 50% of the incident X-ray radiation is randomly scattered, producing a fog or haze in the X-ray image.

It would be advantageous if the amount of scattered X-ray radiation could be reduced.

SUMMARY OF THE INVENTION

It is a main object of the present invention to provide such apparatus and method, wherein the obtained resolution in X-ray imaging is increased.

It is in this respect a particular object of the invention to provide such apparatus and method that allow for X-ray imaging of large objects with improved resolution.

It is still a further object of the invention to provide such apparatus and method that reduce the administrated radiation dose to an object, such as an examined patient.

It is still a further object of the invention to provide such apparatus and method that reduces the noise in the image caused by scattered X-ray radiation.

It is still a further object of the invention to provide such apparatus and method that reduces the cost of X-ray detectors.

It is still a further object of the invention to provide such apparatus and method that reduces the number of electronic channels in large area X-ray detectors.

These objects among others are attained, according to the present invention, by apparatus and methods as claimed in the appended patent claims.

An advantage of the present invention is that the resolution of the X-ray image is increased.

A further advantage is that the administrated radiation dose to an object, to be imaged, is reduced.

A further advantage is that the amount of scattered X-ray radiation in the object to be imaged is reduced.

Further characteristics of the invention and advantages thereof will be evident from the following detailed description of embodiments of the invention.

BRIEF DESCRIPTION OF THE DRAWINGS

The present invention will become more fully understood from the detailed description of embodiments of the present invention given herein below and the accompanying FIGS. 1–7, which are given by way of illustration only, and thus are not limitative of the present invention.

DETAILED DESCRIPTION OF PREFERRED EMBODIMENTS

In the following description, for purposes of explanation and not limitation, specific details are set forth, such as particular techniques and applications in order to provide a thorough understanding of the present invention. However, it will be apparent to one skilled in the art that the present invention may be practiced in other embodiments that depart from these specific details. In other instances, detailed descriptions of well-known methods and apparatuses are omitted so as not to obscure the description of the present invention with unnecessary details.

The present invention may be applied using a variety of X-ray detectors, such as detectors employing direct TFTs, indirect TFTs, CCDs equipped with scintillator, Cmos detectors, PIN-diodes and gas detectors.

TFT detector elements have a minimum size of e.g. 100×100 micrometer. However, if a TFT detector element is made longer it may also be made narrower still maintaining a high fill factor. Thus, it is possible to achieve a TFT detector element being narrower than a conventional TFT and for instance 0.1–100 mm long. Thus, a detector element is achieved having a better spatial resolution than the spatial resolution normally achieved in one direction at the expense of the resolution in the other direction.

Figure 1A:
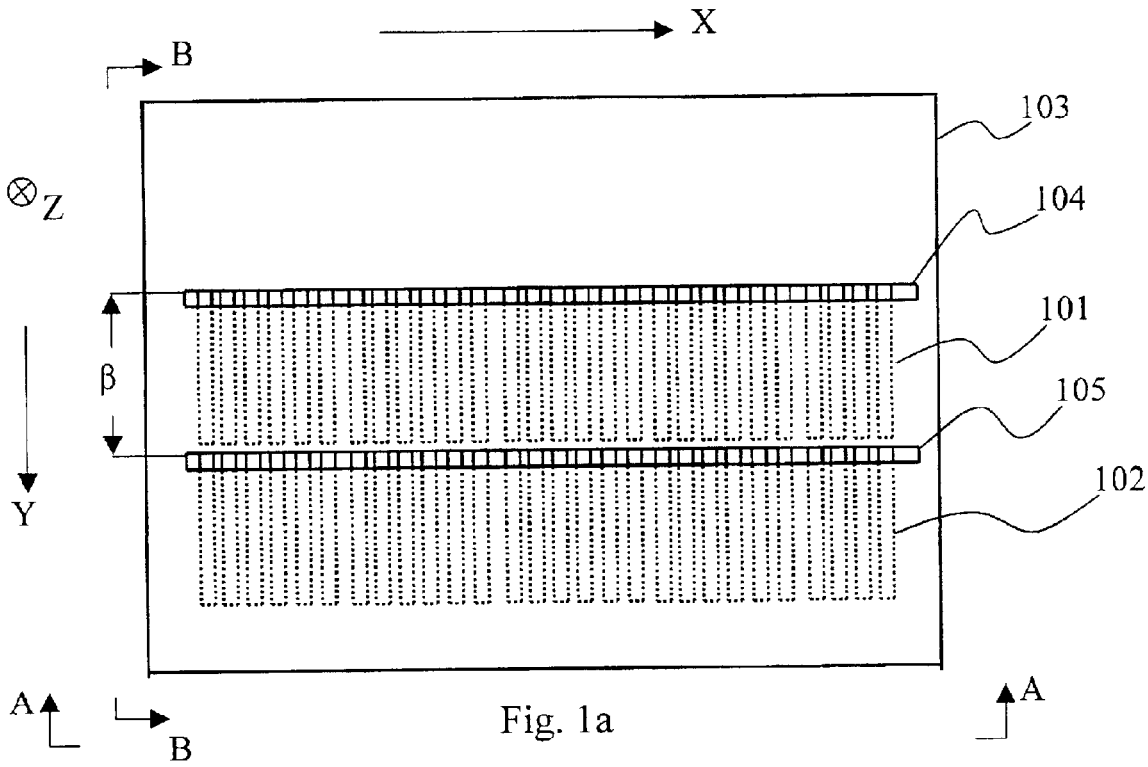
FIG. 1*a* shows a top view of a preferred embodiment of a radiation detector according to the invention with a collimator having two elongated slits and two arrays of elongated detector elements.

FIG. 1*a* shows a top view of a preferred embodiment according to the invention where such elongated detector elements are used. A first array of detector elements 101 and a second array of detector elements 102 are covered with a collimator 103. Each of the arrays 101 and 102 comprise several elongated detector elements arranged, with their respective longer side, side by side, to make up an e.g. 25 cm long array of detector elements. Each of the individual detector elements can be made between 0.01 mm and 5 mm wide, e.g. 50 $\mu$m. This is the distance $\alpha$ in FIG. 1*b*. Each element can then be made between 0.05 and 100 mm long, e.g. 1 mm, distance $\beta$ in FIG. 1*a*. Even though FIGS. 1*a*–1*c* only show two arrays, more arrays may of course be incorporated. Thus, as an example, to cover a 25 cm×25 cm area using 50 $\mu$m wide and 1 mm long detector elements, 250 arrays of 5000 detector elements would be needed.

In the figures each detector element is schematically shown separated from its neighbours by some distance. However, this separation can be made very short, e.g. 3–5 $\mu$m, so that the radiation detecting elements can be regarded, for all practical purposes, to be arranged side-by-side. The figures are thus not to scale.

The collimator 103 is arranged to prevent radiation from reaching the detector elements, apart from at selected areas. Thus, the radiation source (not shown) is placed above the collimator 103, as taken in a Z-direction. The collimator 103 has a first elongated slit 104 and a second elongated slit 105. Each of the elongated slits 104 and 105 is e.g. 50 $\mu$m wide and 25 cm long, thus covering the complete length of each respective array 101 and 102 in a X-direction but only a relative short distance of the length of each individual detector element in a Y-direction. The radiation reaching each detector element is thus limited in the X-direction by the width of the detector element to 50 $\mu$m and limited in the Y-direction to the width of the elongated slits 104 and 105, respectively, to 50 $\mu$m. Thus a spatial resolution is obtained where each pixel is 50×50 $\mu$m. The X-direction, Y-direction and Z-direction are substantially orthogonal.

Figure 1B:
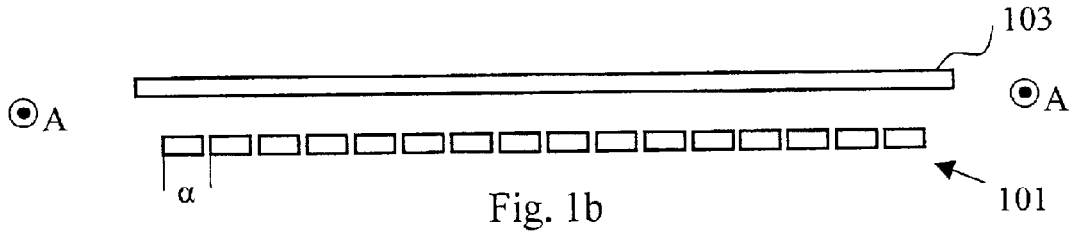
FIG. 1*b* shows a side view taken along the line A—A of the embodiment in FIG. 1.
Figure 1C:
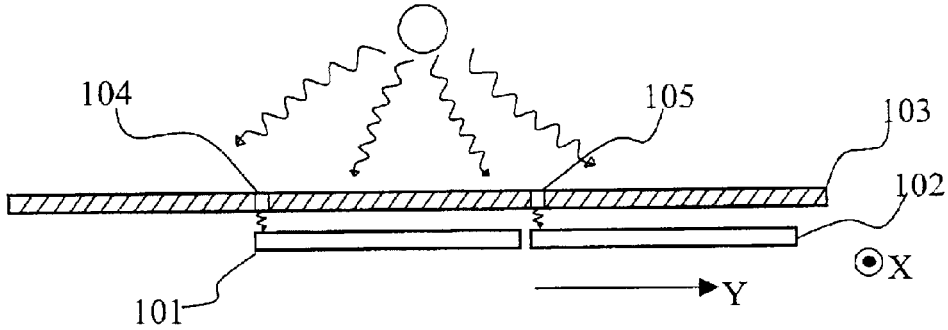
FIG. 1*c* shows a side view taken along line B—B of the embodiment in FIG. 1.

FIG. 1*b* shows the arrangement in FIG. 1*a* taken along the line A—A. FIG. 1*c* shows the arrangement in FIG. 1*a* taken along the line B—B. To achieve an image of the radiation the collimator 103 is moved at constant speed, or alternatively step-wise with e.g. 50 $\mu$m increment in the Y-direction. The slits 104 and 105 will move over the detector element arrays 101 and 102 and let through radiation from different parts of the scanned area to the detector elements during the scanning. The radiation reaching the detector elements is continuously monitored and recorded in a computer (not shown) and an image of the radiation is assembled.

As an alternative the slit 104 may pass over both the detector element arrays 101 and 102. An over sampling, or a double scanning would thus be achieved of the part of object to be imaged that are located above the original position of detecting element array 102. If, as sometimes occur in these kind of detectors, a detector element in array 102 is broken an improved imaged is obtained, since it is very unlikely that the corresponding element in detector element array 101 would also be broken. It should be clear to the man skilled in the art that in practical applications where not only two arrays are used but a multitude of arrays, substantially the complete object would be subject to over sampling. Only the part over the first array would not be subject to over sampling.

It would of course also be possible to move the object to be imaged and the detecting element arrays in relation to a fixed collimator. It is also preferable to move the radiation source with the collimator, as will be discussed later.

Figure 2:
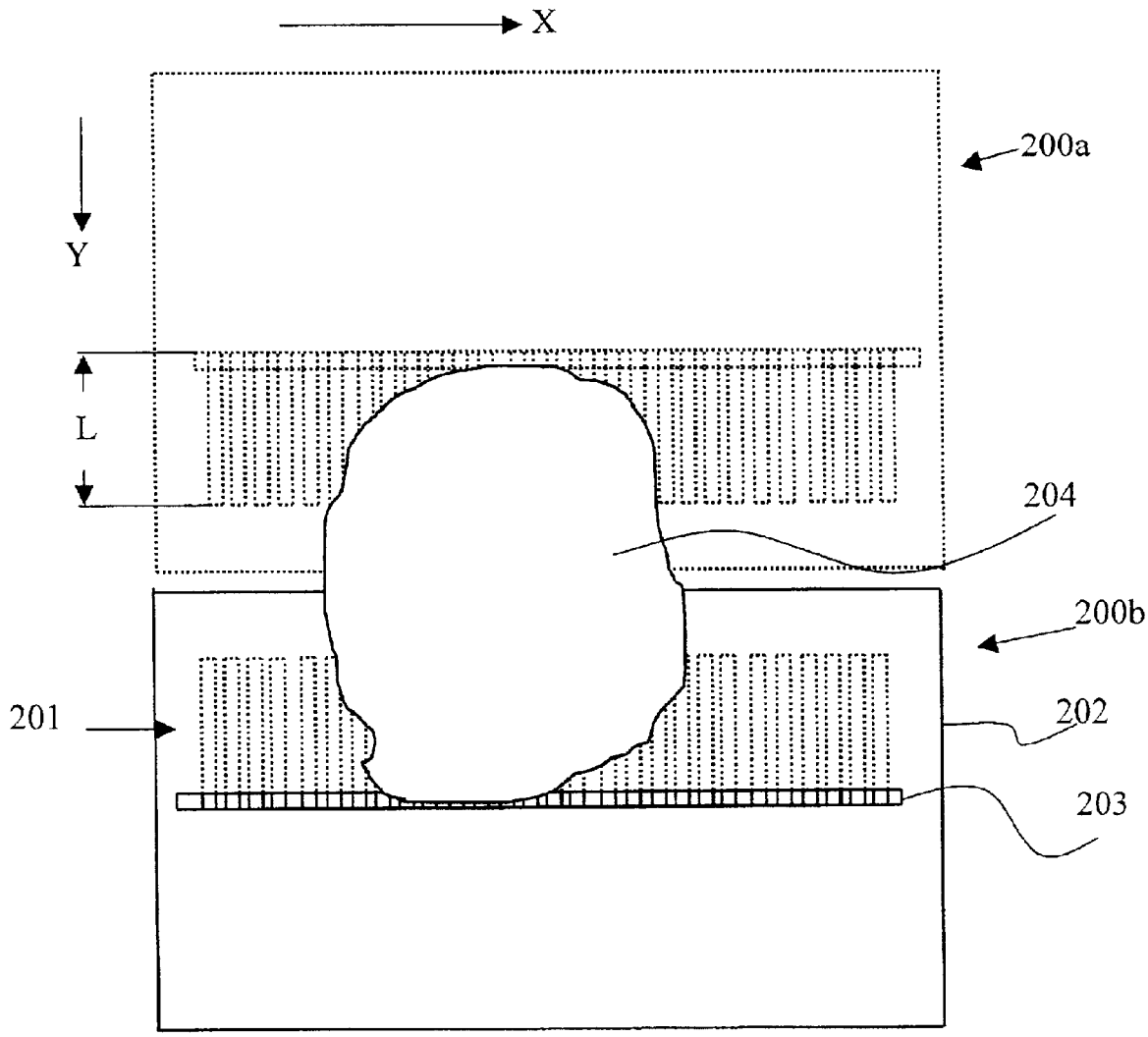
FIG. 2 shows a top view of a preferred embodiment of a radiation detector according to the invention with a collimator having a single slit and one array of detector elements.

FIG. 2 shows a top view of a radiation detector according to a preferred embodiment of the invention where only one array of detector elements 201 is used and a collimator 202 comprises a corresponding elongated slit 203. If an object 204, larger than the detector, as defined by the length of the array of detecting elements in one dimension and the length of the individual detector elements in the other dimension, should be imaged, the detector can be made to move between successive scannings. FIG. 2 shows the detector in a first starting position 200*a*, indicated by dotted lines and in a second end position 200*b*, where the detector has been moved in the Y-direction in successive steps of length L, where L is the length of the detector elements in the y-direction, so as to scan the object 204. Thus the slit 203 is brought over the complete area of the object 204 and an image is recorded. That is, both the detector, comprising the array of detector elements 201, and the collimator is moved during the scan.

Figure 3:
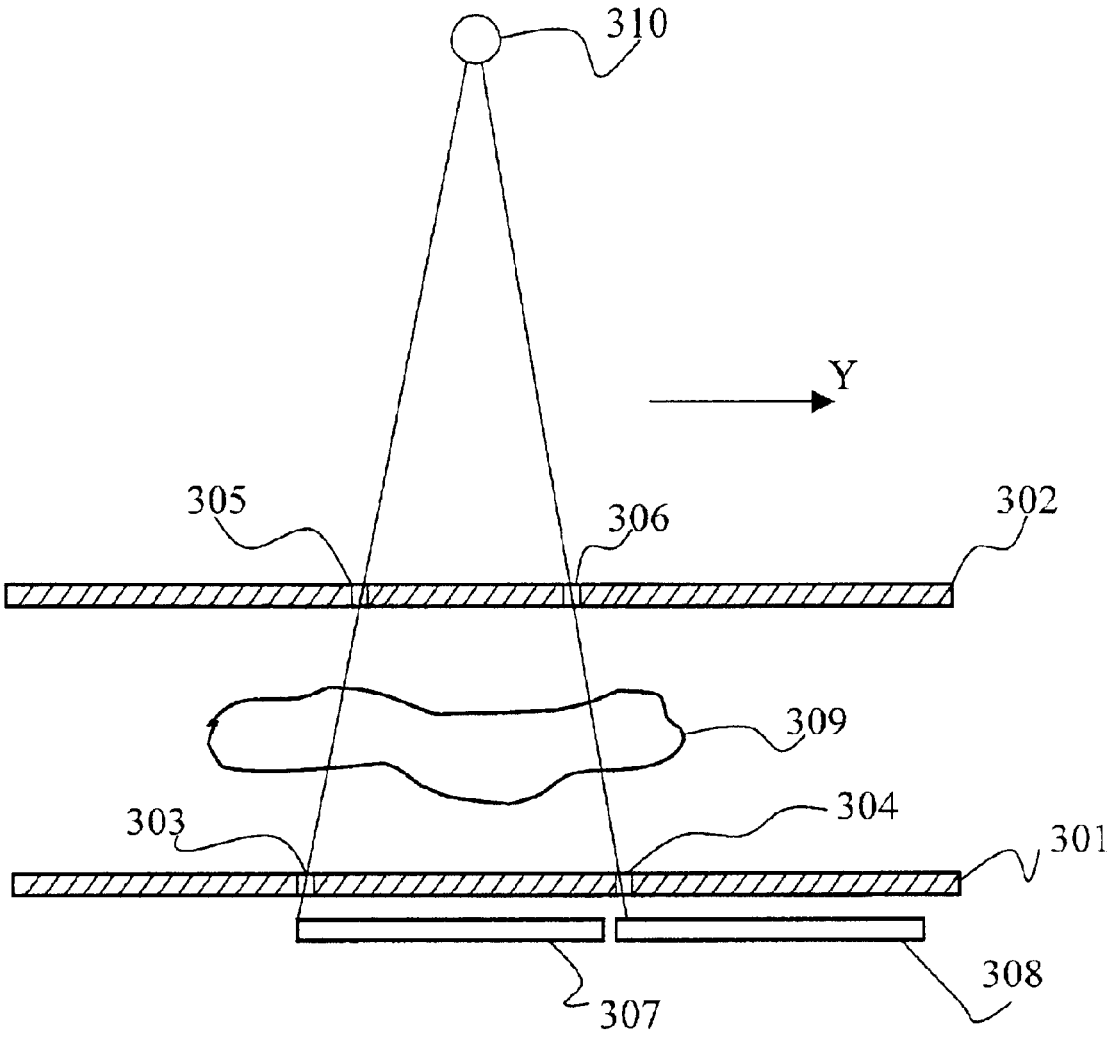
FIG. 3 shows a side view of a preferred embodiment of a radiation detector according to the invention with two arrays of detector elements and two collimators each having two slits.

FIG. 3 shows a side view of a preferred embodiment according to the invention comprising a first collimator 301 and a second collimator 302. The first collimator 301 has two elongated slits 303 and 304 and the second collimator has two elongated slits 305 and 306 aligned with the first collimators 301 slits 303 and 304. The elongated slits 303 and 304 are preferably arranged at the projection of incident X-ray radiation, emitted by a radiation source 310, through the slits 305 and 306.

A first array of detector elements 307, of which only the first detector element is visible in this view, and a second array of detector elements 308, of which only the first detector element is visible in this view, are arranged below said first collimator 301. The first 301 and second 302 collimator are arranged at a distance to allow for an object 309, to be imaged, to be positioned there between. The primary purpose of the first collimator 301 is to prevent radiation from reaching the detector elements 307 and 308 in other positions than governed by the slits 303 and 304. The primary purpose of the second collimator 302 is to reduce the radiation dose to the object 309. This is specifically important where a living object, such as a human, is to be imaged.

The radiation source 310 radiates X-rays towards the second collimator 302. The second collimator transmits photons only through the slits 305 and 306 and photons thus radiate the object 309 substantially only directly under the slits 305 and 306.

The slits 303 and 304 transmit radiation towards the detector elements 307 and 308 so that a reading is obtained relating to the radiation passing through the object 309.

The collimators 301 and 302 and the radiation source 310 are moved in fixed relation to each other in the Y-direction, while radiation data is continuously read by the detector elements 307 and 308, scanning the object 309.

Figure 4:
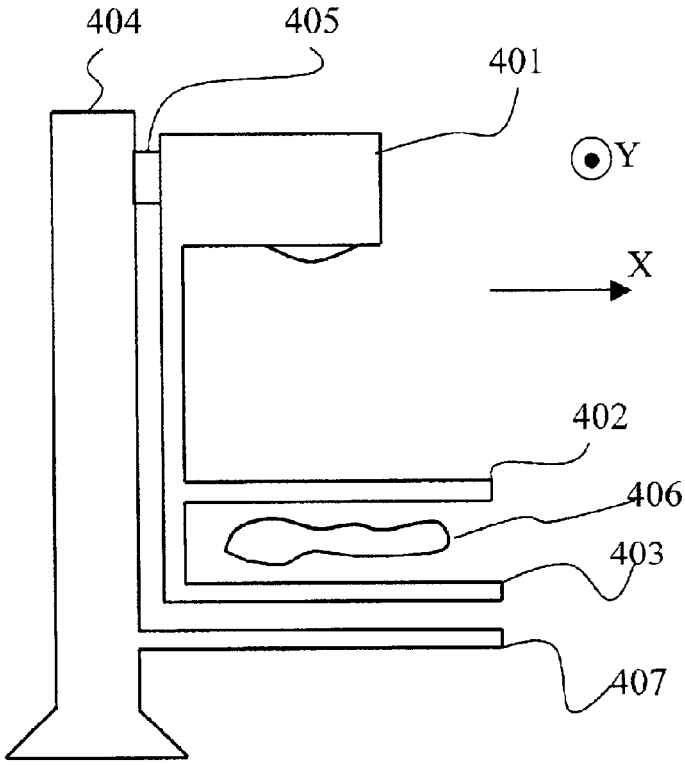
FIG. 4 shows a side view of an E-arm type of X-ray radiation detecting apparatus according to the invention.

FIG. 4 shows a schematic drawing in side view of an E-arm detector apparatus according to a preferred embodiment of the invention. The E-arm comprises a first arm 401 carrying the radiation source, a second arm 402 carrying a first collimator and a third arm 403 carrying a second collimator. The first, second and third arms are fixed in relation to each other. The radiation source is arranged to radiate X-rays towards the first collimator. The E-arm is attached to a stand 404 so as to allow the E-arm to expose a pendulum movement around an axis 405, and/or a horizontal transverse movement along the x- or y-direction. An object 406 to be imaged is positioned between the first and second collimators and is fixed in relation to the stand 404. By moving the E-arm a scanning of the object 406 is achieved. A fourth arm 407 is carrying the radiation detecting elements. The fourth arm 407 may be independently movable in relation to the E-arm as required by some embodiments described herein.

Figure 5:
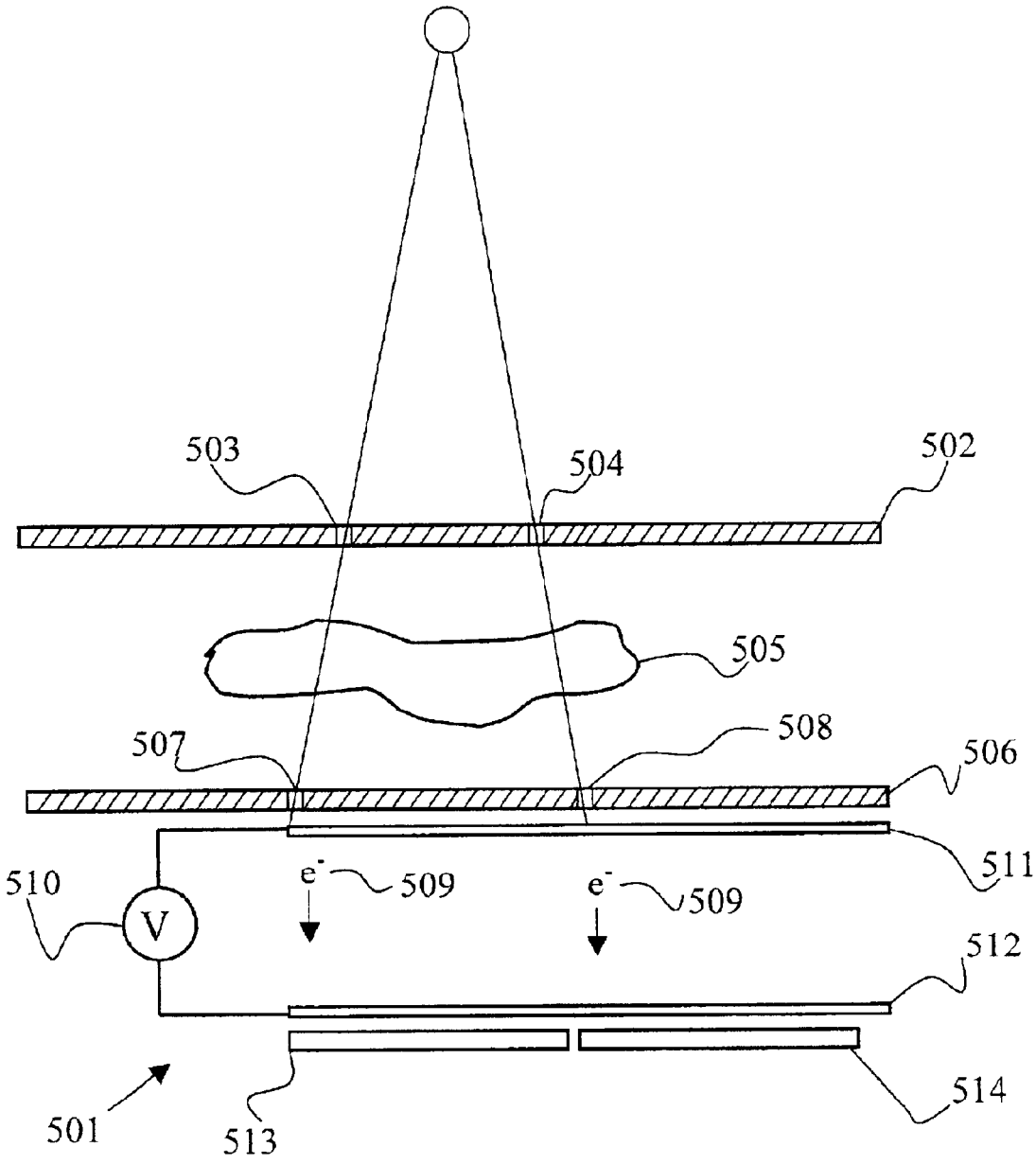
FIG. 5 shows a side view of a preferred embodiment of a radiation detector according to the invention employing a gas detector.

FIG. 5 shows a side view of a preferred embodiment according to the invention where a gas detector 501 is employed. Gas detectors are per se known and thus no detail will be given as to the specific operation of the gas detector 501. In this respect we refer to our co-pending patent applications by Francke et al. having U.S. Pat. Nos. 09/443,294, 09/698,173, 09/709,305, 09/752,722 and the Swedish patent application by Francke et al. having Swedish patent application number SE 0102097-3 all incorporated herein by reference.

A first collimator 502 comprises slits 503 and 504, respectively. The first collimator 502 is primarily used for preventing excess radiation to reach an object 505 to be imaged. Slits 503 and 504 admit radiation towards to object 505 along defined openings. A second collimator 506, having two slits 507 and 508 respectively, is arranged over the gas detector 501 for admitting X-ray photons into the gas detector 501. The photons ionize the gas, resulting in that electrons, schematically indicated 509 in FIG. 6*a*, being released. The electrons, accelerated by a voltage 510 applied over a cathode 511 and an anode 512, is registered by two different detector elements 513 and 514, respectively. Alternatively, the voltage 510 may be strong enough to cause electron avalanche amplification during the acceleration towards the detector elements 513 and 514, respectively. The collimators 502 and 506 are moved in the Y direction in relation to the gas detector 501 to perform a scan of the object 505 and thus a 2-dimensional image is recorded.

It should be clear that, even though two collimators have been shown in FIG. 5, one of the collimators 502 and 506 might be disposed with. If the amount of radiation reaching the object 505 is of no importance, the collimator 502 may be omitted. The arrangement in FIG. 6*a* may instead do without collimator 506 but, due to scattering of radiation, a lower resolution might be achieved.

It should also be clear that, even though the detector elements 513 and 514 have been depicted as being located below the anode 512, they could equally well be positioned above the anode 512, arranged to function as the anode, in which case the anode 512 would be replaced with the detector elements, or the detector elements could even be positioned adjacent the cathode, in which case they would detect positive ions.

Figure 6:
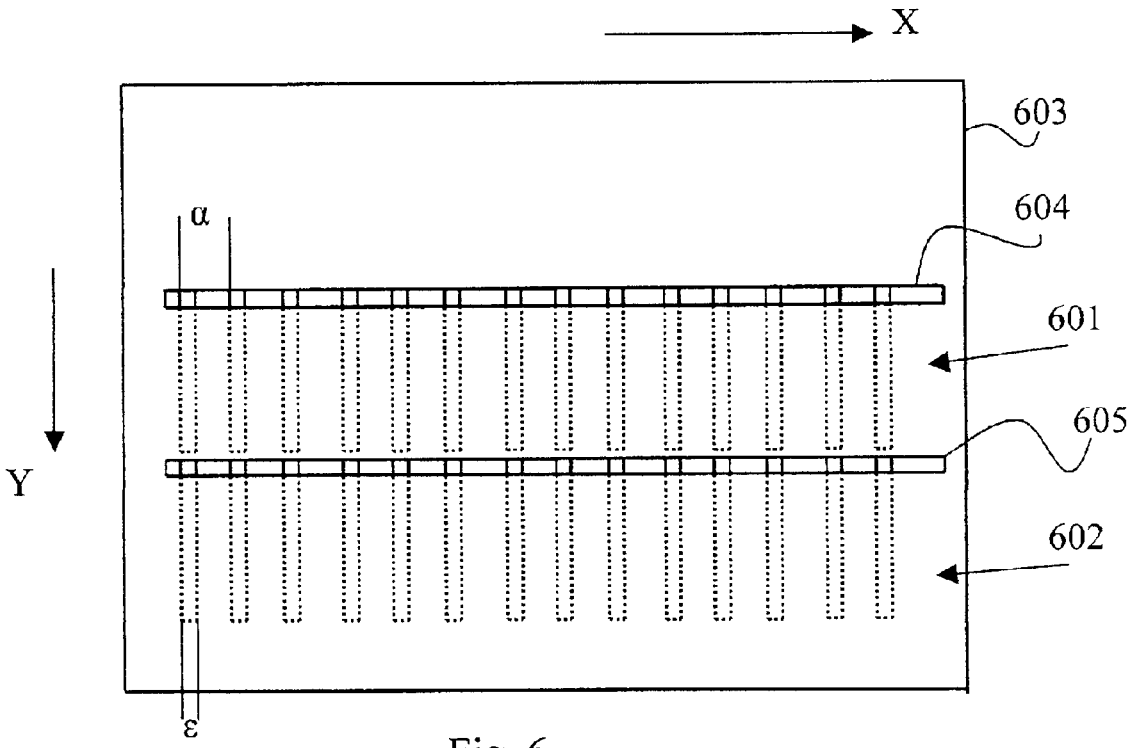
FIG. 6 shows a top view of a preferred embodiment of a radiation detector according to the invention where the detector elements are arranged with a distance between adjacent detector elements.

FIG. 6 shows a preferred embodiment according to the invention having a first 601 and a second 602 array of detector elements. A collimator 603 has two slits 604 and 605 for admitting radiation towards selected parts of the detector element arrays 601 and 602. The detector elements in the two arrays of detector elements 601 and 602 are arranged with a distance $\alpha$ from each other, e.g. 2 mm, in X-direction. In this embodiment $\alpha$ is substantially larger than a distance $\epsilon$, being the width of the detecting area in the X-direction of the detector element. In other aspect the present embodiment is similar to the embodiment described in connection with for instance FIG. 1.

To obtain a complete 2-dimensional image of an object it is thus necessary to scan not only in the Y-direction by moving the collimator 603, but also to scan in the X-direction by movement of the detector arrangement, as defined by all individual detector elements, and the collimator 603 (and also possibly the radiation source) but not the object. First the collimator 603 moves in the Y-direction from its start position to its end position scanning over substantially the complete length of the detector elements. Thus, a set of image lines is obtained, however the lines are separated by the distance $\alpha$ in the X-direction. To obtain a complete 2-dimensional image the detector arrangement and the collimator is moved in the X-direction a distance $\epsilon'$ substantially equal to the line width distance $\epsilon$, e.g. 50 $\mu$m. The collimator is again moved in the Y-direction, however this time in the opposite direction from what was the end position during the first scan, to what was the start position during the first scan, to obtain a second set of image lines in the Y-direction. The process is then repeated until the detector elements 601, 602 and the collimator 603 has moved substantially the complete distance $\alpha$.

Thus, in summary, the collimator 603 can be said to oscillate back and fourth in the X-direction, while the detector elements 601 and 602, together with the collimator, is moved a line width distance in the X-direction, at each turning of the collimator.

Even though, the FIG. 6 only shows two arrays of detector elements with 14 detector elements each, a complete detector arrangement would typically include many more arrays having many more detector elements. Typically, in practical applications, a detector arrangement, which would cover 25×25 cm, could employ detector elements having a length in Y-direction of 5 mm, and in X-direction of 50 $\mu$m, being separated with 2 mm. Such an arrangement would thus have 250/5=50 arrays of detector elements, each array having 125 detector elements. Of course the collimator would have 50 slits, each slit corresponding to a respective detector array. The detector would need approximately 40 scans to complete a 2-dimensional image. If the dose administrated to the object to be imaged need to be minimal, a second collimator might be employed.

It should be noted that in the description given above no specific detail has been given to the electronics involved in reading the individual radiation values by the radiation detecting elements or regarding how the assemble the images from the obtained pixel data. This is, however, well known to the man skilled in the art and the present description is therefore not burdened with these details.

It will be obvious that the invention may be varied in a plurality of ways. For instance, the number of radiation detecting elements, arrays and slits may be varied without limitations. Such variations are not to be regarded as a departure from the scope of the invention. All such modifications as would be obvious to one skilled in the art are intended to be included within the scope of the appended claims.

What is claimed is:

1. An apparatus for detection of radiation comprising:

at least a first collimator arranged to transmit radiation, emitted from a radiation source, through at least a first slit in a Z-direction and prevent radiation in said Z-direction apart from through said at least first slit, at least a first array of at least two radiation detecting elements, each of said radiation detecting elements having a width $\alpha$ in an X-direction, where said X-direction is the direction of said array of radiation detecting elements, each of said radiation detecting elements having a length $\beta$ in a Y-direction, said at least first slit, for letting through radiation in the Z-direction, having a length in said second X-direction which is at least as long as said array of radiation detecting elements, said at least first slit having a length in said Y-direction which is substantially shorter than said length $\beta$ of said radiation detecting elements, and displacement means arranged to move said collimator and/or said array of radiation detecting elements.

2. The apparatus according to claim 1, wherein at least a second array of radiation detecting elements, having said width $\alpha$ in said X-direction and said length $\beta$ in said Y-direction, said at least first array of radiation detecting elements and said at least second array of radiation detecting elements being displaced in relation to each other substantially only in the Y-direction with a distance substantially equal to $\beta$, said collimator comprise at least a second slit having a length in said second X-direction which is at least as long as said at least second array of radiation detecting elements, and a length in said Y-direction which is substantially shorter than said length $\beta$, said at least first and at least second slits being displaced in relation to each other substantially only in the Y-direction with a distance substantially equal to $\beta$, and said first and second slits are fixed in relation to each other, and said first and second arrays of radiation detecting elements are fixed in relation to each other.

3. The apparatus according to claim 1, wherein said displacement means is arranged to move said collimator in relation to said radiation detecting elements in said Y-direction over substantially the complete length $\beta$ of said radiation detecting elements.

4. The apparatus according to claim 1, wherein said displacement means is arranged to move said collimator in relation to said radiation detecting elements in said Y-direction over a length substantially longer than the length $\beta$, e.g. $2*\beta$, $3*\beta$ or any multiple of $\beta$.

5. The apparatus according to claim 1, wherein each of said radiation detecting elements is arranged to repeatedly detect values during the relative movement of said collimator and radiation detecting elements so as to obtain multiple values for the radiation admitted through said slit to said corresponding radiation detecting elements.

6. The apparatus according to claim 1, wherein said movement is a translation of said collimator in the Y-direction over said at least first array of radiation detecting elements.

7. The apparatus according to claim 1, wherein said movement is a pivoting movement of the collimator and radiation source in relation to the radiation detecting elements.

8. The apparatus according to claim 1, wherein said collimator is arranged to substantially completely cover each of said radiation detecting elements, during said movement, from radiation, apart from radiation admitted through said slit to said radiation detecting elements.

9. The apparatus according to claim 8, wherein a second collimator, having at least two elongated openings separated by a distance β, is arranged at a distance γ in the Z-direction from said first collimator, wherein said distance γ is selected to allow an object to be positioned between said first and second collimator, and said first and second collimator is fixed in relation to each other so that X-rays emitted from the X-ray source and transmitted through said slits in the second collimator are transmitted through the corresponding slits in the first collimator.

10. The apparatus according to claim 1, wherein said width α is substantially shorter than said length β, and said length of said array is substantially longer than said length β.

11. The apparatus according to claim 1, wherein said radiation detection means is a CCD.

12. The apparatus according to claim 1, wherein said radiation detecting elements is a TFT array.

13. The apparatus according to claim 1, wherein said radiation detecting elements is a C-mos detector.

14. The apparatus according to claim 1, wherein said radiation detecting elements is PIN-diodes.

15. The apparatus according to claim 1, wherein said apparatus comprises a gas detector having an ionisable gas arranged between an anode and an cathode and being arranged to detect electrons emitted by said gas due to said radiation and accelerated by a voltage across said anode and cathode.

16. The apparatus according to claim 15, wherein said gas detector comprises means for electron avalanche amplification.

17. The apparatus according to claim 1, wherein said detector elements comprise a radiation detection area which is substantially as wide in the X-direction as said distance α.

18. The apparatus according to claim 1, wherein said detector elements comprise a radiation detection area, which has a width ϵ in X-direction that is substantially shorter than said distance α.

19. The apparatus according to claim 18, wherein said displacement means is arranged to repeatedly move said collimator in relation to said radiation detecting elements back and fourth in said Y-direction over substantially the complete length β of said radiation detecting elements, and said displacement means is arranged to move said radiation detecting elements and said collimator substantially a distance ϵ in the X-direction for each repetition of movement in said Y-direction.

20. An X-ray imaging device comprising the detector apparatus according to claim 1, comprising an X-ray source arranged displaced in the Z-direction in relation to said collimator and arranged to emit X-rays in at least said Z-direction towards said radiation detection means and said radiation is arranged to pass through an object to be imaged, said collimator being arranged to scan over substantially the complete object, and said radiation detection device being arranged to repeatedly detect the radiation reaching said radiation detection device so as to construe a scanned image of the X-rayed object.

21. A method for detection of radiation comprising:

at least a first collimator arranged to transmit radiation through at least a first slit in a Z-direction and prevent radiation in said Z-direction at other positions, at least a first array of radiation detecting elements comprising at least two radiation detecting elements, that each of said radiation detecting elements having a width α in a X-direction, where said X-direction is the direction of said array of radiation detecting elements, that each of said radiation detecting elements having a length β in a Y-direction, that said at least first slit, for letting through radiation in the Z-direction, has a length in said second X-direction which is at least as long as said array of radiation detecting elements, that said at least first slit has a length in said Y-direction which is substantially shorter than said length β of said radiation detecting elements, and comprising the step of:

moving said collimator in relation to said radiation detecting elements in the Y-direction over substantially the complete length β of said radiation detecting elements.

22. The method according to claim 21, comprising at least a second array of radiation detecting elements, having same characteristics as said at least first radiation detecting elements, said collimator comprise at least a second slit having same characteristics as said at least first slit, and comprising the further steps of:

displacing said at least first and at least second slit in relation to each other substantially only in the Y-direction with a distance substantially equal to β, displacing said at least first array of radiation detecting elements and said at least second array of radiation detecting elements in relation to each other substantially only in the Y-direction with a distance substantially equal to β, and fixing said first and second slit, and said first and second array of radiation detecting elements in relation to each other.

23. The method according to claim 21, comprising the further step of:

continuously detecting a value corresponding to the detected radiation during the relative movement of said collimator and radiation detecting elements, so as to obtain multiple values for the radiation admitted through said slit to said corresponding radiation detecting elements.

24. The method according to claim 21, wherein said movement is a translation of said collimator in the Y-direction over said at least first array of radiation detecting elements.

25. The method according to claim 21, wherein said movement is a pivoting movement of the collimator and radiation source in relation to the radiation detecting elements.

26. The method according to claim 21, wherein said width α is substantially shorter than said length β, and said length of said array is substantially longer than said length β.

27. The method according to claim 21, wherein said radiation detection means is a CCD.

28. The method according to claim 21, wherein said radiation detecting elements is a TFT.

29. The method according to claim 21, wherein said radiation detecting elements is a C-mos detector.

30. The method according to claim 21, wherein said radiation detecting elements is PIN-diodes.

31. The method according to claim 21, wherein said radiation detection means comprises a gas detector having an ionisable gas arranged between an anode and an cathode and being arranged to detect electrons emitted by said gas due to said radiation and accelerated by a voltage across said anode and cathode.

32. The method according to claim 31, wherein said gas detector is arranged to perform electron avalanche amplification.

33. The method according to claim 21, wherein a second collimator, having at least two elongated openings separated by a distance $\beta$, is arranged at a distance $\gamma$ in the Z-direction from said first collimator, wherein said distance $\gamma$ is selected to allow an object to be positioned between said first and second collimators, and said first and second collimator is fixed in relation to each other so that X-rays emitted from the X-ray source and transmitted through said slits in the second collimator are transmitted through the corresponding slits in the first collimator.

34. The method according to claim 21, wherein said detector elements comprise a radiation detection area which is substantially as wide in the X-direction as said distance $\alpha$.

35. The method according to claim 21, wherein said detector elements comprise a radiation detection area, which has a width $\epsilon$ in X-direction that is substantially shorter than said distance $\alpha$.

36. The method according to claim 35, wherein said displacement means is arranged to repeatedly move said collimator in relation to said radiation detecting elements back and fourth in said Y-direction over substantially the complete length $\beta$ of said radiation detecting elements, and said displacement means is arranged to move said radiation detecting elements and said collimator substantially a distance $\epsilon$ in the X-direction for each repetition of movement in said Y-direction.

* * * * *